US005263744A

United States Patent [19]

Linder

[11] Patent Number: 5,263,744

[45] Date of Patent: Nov. 23, 1993

[54] SPECIALIZED ORDER FORM TECHNIQUE TO RAPIDLY OBTAIN BEST ORDER NUMBERS FOR PRODUCTS

[76] Inventor: Andreas Linder, Merz Str. 10, 8000, Munich, 80, Fed. Rep. of Germany

[21] Appl. No.: 879,565

[22] Filed: May 7, 1992

[51] Int. Cl.[5] ..... B42D 15/00

[52] U.S. Cl. ..... 283/115; 283/55; 283/66.1

[58] Field of Search ..... 283/116, 55, 115, 66.1, 283/66.2; 281/38, 42, 51

[56] References Cited

U.S. PATENT DOCUMENTS 3,785,681 1/1974 Jackowitz ..... 283/55

*Primary Examiner*—Mark Rosenbaum
*Assistant Examiner*—Willmon Fridie, Jr.
*Attorney, Agent, or Firm*—Thomas I. Rozsa; Dong Chen

[57] ABSTRACT

The present invention relates to an ordering system that rapidly obtains the best order number from a catalog of product information and associating, in a row and column tabular overlay format, corresponding product information of products in various companies which are compatible to the desired product.

12 Claims, 2 Drawing Sheets

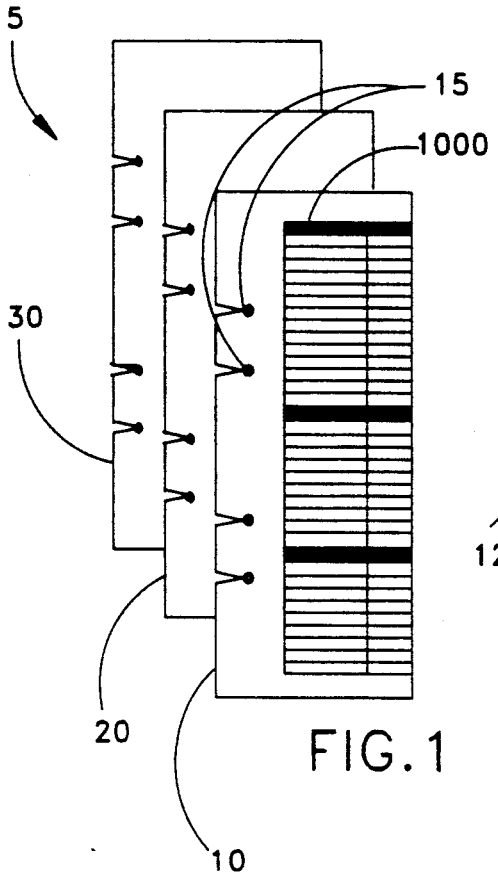
FIG. 1
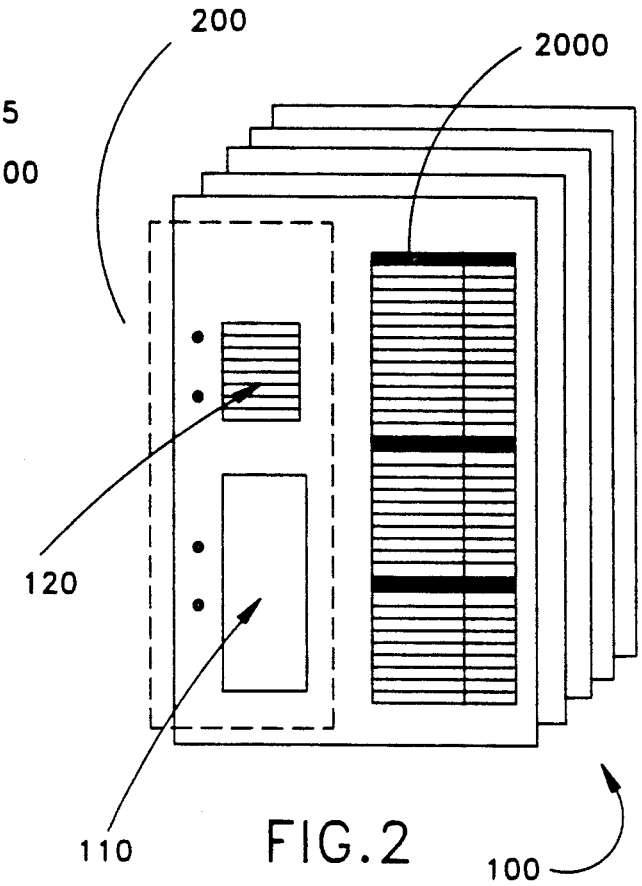
FIG. 2
FIG. 3
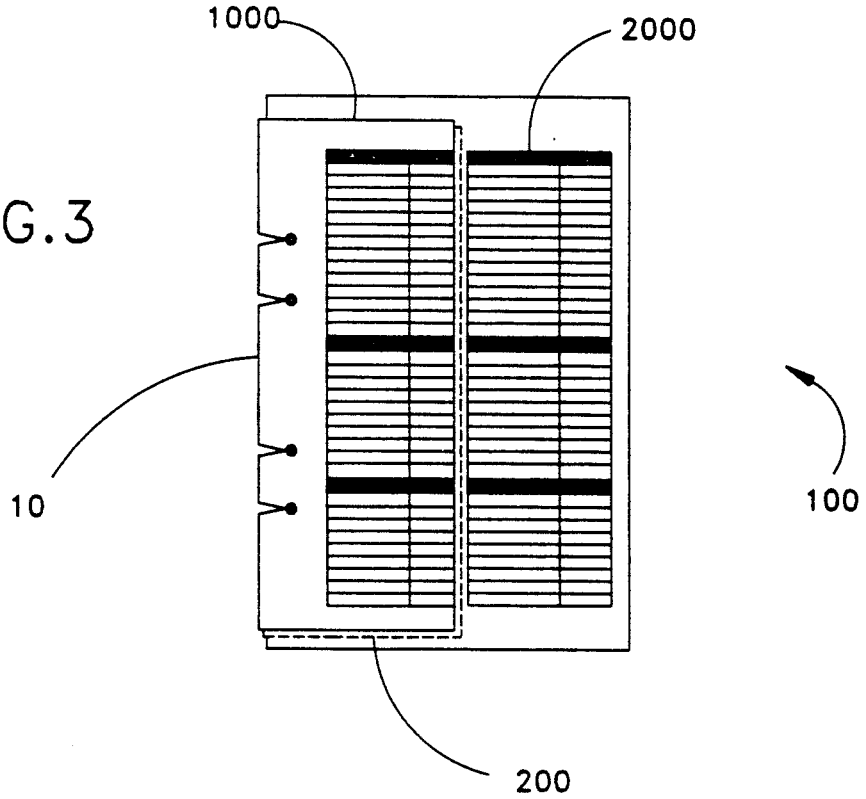

FIG. 4
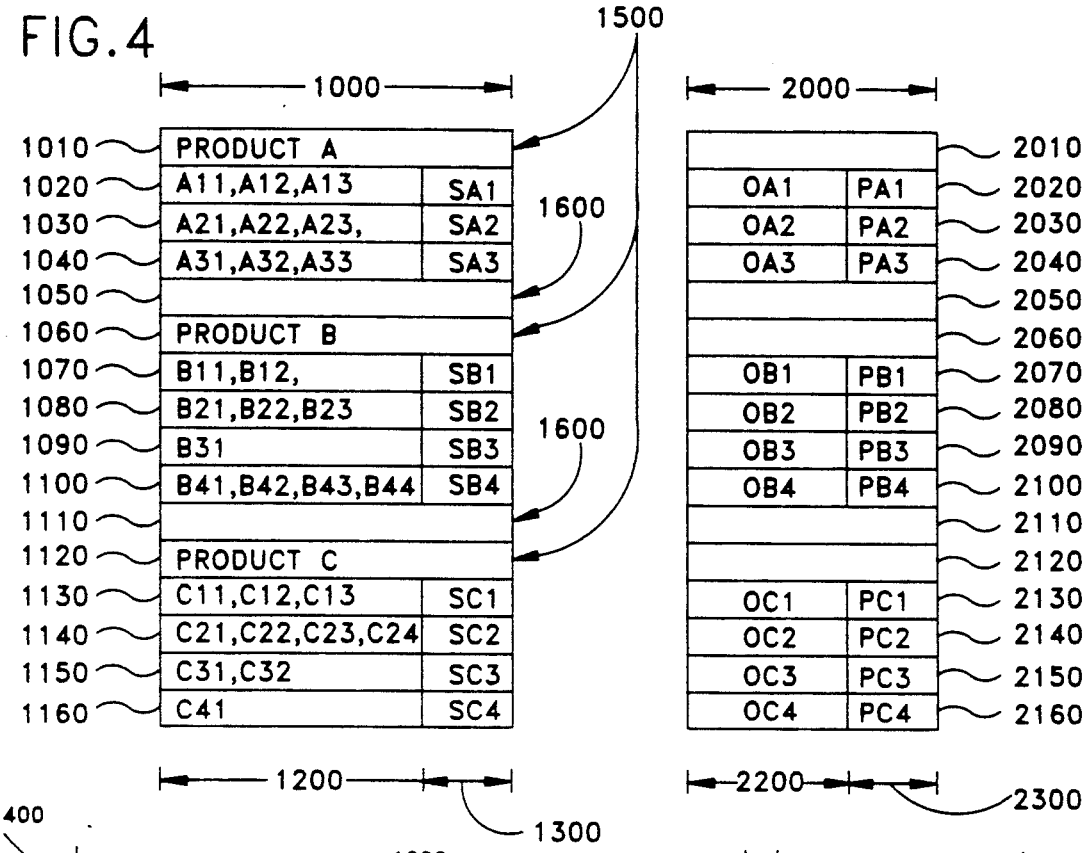
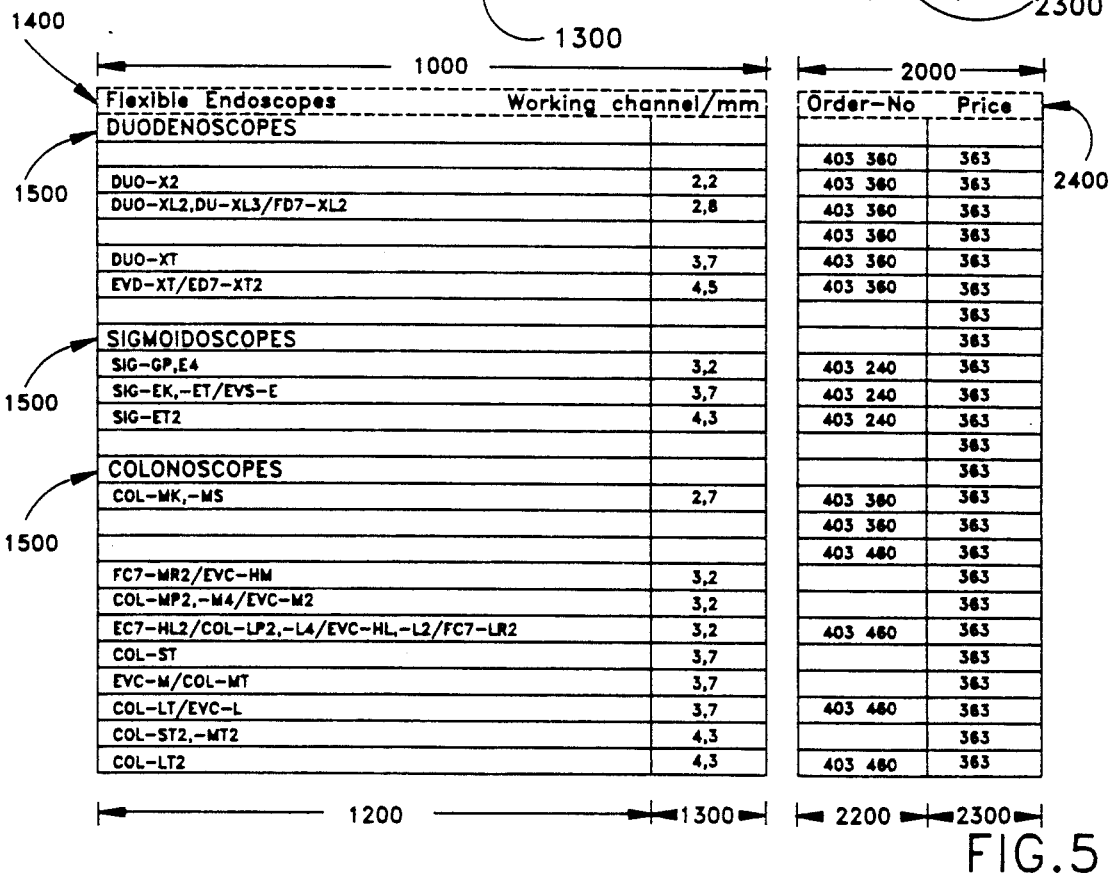
FIG. 5

SPECIALIZED ORDER FORM TECHNIQUE TO RAPIDLY OBTAIN BEST ORDER NUMBERS FOR PRODUCTS

1. Field of the Invention

This invention relates to the field of referencing and displaying business information. Specifically, the present invention relates to an ordering system that rapidly obtains the "best order number" from a catalog of product information and associating, in a row and column tabular overlay format, corresponding product information of products in various companies which are compatible to the desired product.

2. Description of the Prior Art

Methods of referencing and displaying business information are known in the prior art. The present invention relates to an ordering system that enables a user to rapidly obtain the "best order number" and associated business information such as price, or inventory stock, for various business situations where it is crucial to have current information readily available.

In business situations such as in marketing, it is often advantageous to offer to a customer or potential customer a way of obtaining the prices and inventory of a specific product category in an easy to access manner. Product information, specifications, written description and illustrations of the product are often displayed in a company's product catalog for referencing.

In situations where the product information is lengthy and detailed, especially in highly specialized markets, the product information and its compatibility to other related products are often obscured in complex arrays of price lists and supply number codings which are often difficult to use and time consuming to decipher. It would be practical to have an improved method for finding specific marketing information which relates to products used in conjunction with corresponding products of interest. It would also be advantageous, particularly in business situations where ease of accessibility to product information is often crucial to the successful marketing of competitive products, to present the information in an easy to comprehend manner.

When a person is searching for highly specialized products of a particular category which are adaptable to existing products or systems, there is a need to organize the highly specialized products according to an efficient and systematic matrix, which can correlate a "best order number" to an array of appropriate detailed product information items. Items of interest could be: price information, current inventory, specification, compatibility with the products of other companies and other items which are directly related to the product.

To reference the information in easy to access manner, a "best order number" system could relate a desired product and price to a corresponding class of products or systems which are used in conjunction with the desired product, thereby enabling the user to rapidly determine the extent of compatibility of the desired product to an existing product or system. The "best order number" can correspond to a multiplicity of manufactures whose products are compatible with the desired product. Additionally, the "best order number" has significance to the coordination of production with respect to tracking inventory. Furthermore, the "best order number" can readily identify the product unit price, specification, features and other associated product information.

It is advantageous to be able to quickly find and display desired product information. An overlay technique of aligning tabular row and column data is useful in that regard. Column data which is aligned to other columns of data fixed in catalogs is both easy to display and associate. By selecting an overlay from an assortment of overlays representing varying company products and systems which are compatible to the product under consideration, a product and it associated price and available inventory can also be retrieved very quickly. By organizing corresponding manufactures on a separate overlay, where the overlay fits exactly to a product catalog, it is possible to enhance the accessibility of the information for the user.

The manner in which product information is presented becomes particularly important in highly specialized markets, where product information is often intricate and tedious to reference. In this situation, it is advantageous for a seller to simplify the process of locating the information for the buyer. A competitive edge in marketing can be gained where the seller is able to provide product information to a potential customer in a minimum amount of time and difficulty. Effective presentation of product information is essential to the success of a business.

A "best order number" reference system could provide a method of finding price listings, current inventories and other pertinent business information, as well as corresponding to compatible products of various different companies in highly specialized industries.

It is also useful to be able to quickly find information from a company's current supply catalog such as inventories of stock on hand and to be able to reference that information to the current supply catalog which carries the many different sizes and specifications and lists the particular features of the product under evaluation. Currently, this kind of information is particularly difficult to access in highly specialized industries where several versions of identical products exist. Products which are presented in catalogs with detailed product selections are generally difficult to find and associate to compatible products because of the lack of a standardized indexing system between various companies. To facilitate the referencing of this information, a "best order number" is assigned which references the product category under interest to an assortment of companies which offer products or systems which are compatible with the articles of interest.

In the present invention, the buyer, seller or the business manager could examine specific product categories and reference various other companies which are compatible with the products or systems assigned to a particular product category through a best number system, a specialized order form technique.

Therefore the uniqueness of the present invention is the "best order number" reference system: which standardizes the display of product data in a specific product category and also displays product data of compatible products; which provides a method of associating corresponding and compatible products among a variety of companies; which provides a method of finding current inventories of a product; which displays other cross referenced information of similar products in highly specialized markets; and which provides an easy to access method of comparing business information in a particular product category; and by presenting the business information in a tabular overlay format which corresponds to a catalog of information and where the overlays aligns exactly to the catalog of product information.

The following nine patents are the closest prior art of which the inventors are aware.

1. U.S. Pat. No. 4,475,288 issued to Pellegrom (hereafter the "Pellegrom Patent") on Oct. 9, 1984 for "Registry Device and Method For Using Same".

2. U.S. Pat. No. 4,832,373 issued to Swan (hereafter the "Swan Patent") on May 23, 1989 for "Selective Data Blocking Overlay".

3. U.S. Pat. No. 3,884,507 issued to Fumel (hereafter the "Fumel Patent") on May 20, 1975 for "Menu".

4. U.S. Pat. No. 4,161,330 issued to Ross (hereafter the "Ross Patent") on Jul. 17, 1979 for "Inventory Comparison System".

5. U.S. Pat. No. 4,475,811 issued to Brunner (hereafter the "Brunner Patent") on Oct. 9, 1984 for "Overlay Test Measurement Systems".

6. U.S. Pat. No. 4,559,705 issued to Hodge et al. (hereafter the "Hodge Patent") on Dec. 24, 1985 for "Indexing Overlay for Video Display Devices".

7. U.S. Pat. No. 4,603,884 issued to Burton (hereafter the "Burton Patent") on Aug. 5, 1986 for "Lotto Ticket Marking Guide".

8. U.S. Pat. No. 4,986,573 issued to Brunhoefer (hereafter the "Brunhoefer Patent") on Jan. 22, 1991 for "Layout Sheet".

9. U.S. Pat. No. 5,011,191 issued to Gannon et al. (hereafter the "Gannon Patent") on Apr. 30, 1991 for "View-Through Information Converter".

The Ross Patent discloses an inventory comparison system for comparing an inventory of a competitor's products with a supplier's suggested inventory. An arrangement of competitor's part numbers is displayed on a sheet in similar arrangement to a second sheet which lists the supplier's data which is identical to the first arrangement and has a cover with an opening which allows easy locating of the first sheet's information associated to the second sheet's information thereby establishing a viewable means of identifying the inventory of two vendors. The Ross Patent utilizes openings on a sheet to hide certain information and the user narrowly lines up the supply numbers of company A, to company B in a simple line to line comparison technique.

Important differences distinguish the present invention from the Ross Patent. The present invention utilizes a "best order number" reference system: which standardizes the product data of a specific product category with product data of compatible products; which provides a method of finding corresponding price listings of the compatible products; which provides a method of finding current inventories of a product; which displays cross referenced information of similar products in highly specialized markets; which provides a method of comparing business information between different companies in a particular product category; and displays the information in an easy to access manner by presenting the data in an overlay format where the overlay corresponds to a catalog of information and where the overlay aligns exactly to the catalog.

The "best order number" feature of the present invention is adaptable to other means of data management and would be very useful in the event of the organization of the business information in a computer database format. Computer databases are commonly used to efficiently store and process information in highly specialized markets. In a computer database, the "best order number" could reference graphics, string characters and other information descriptive of the product category designated by the "best order number". In effect, the "best order number" could be an important global-variable in a computerized database structure contributing to efficient and productive business operations. The "best order number" method of database management has not been considered in the Ross Patent.

Another difference between the present invention and the Ross Patent is that the present invention displays the product comparison information in a tabular column structure which is easy to access through an overlay to a catalog of product information. The overlay is used to compare compatible products and specifications to a catalog of information which aligns exactly to the information in the overlay. In the present invention, when a business manager who wants to compare compatible products of one company to those products and prices in his supply catalog, he simply finds the overlay in which the other company's product is listed, and he aligns the overlay to the page of his catalog, thereby providing an easily accessible means of showing a potential customer the products, specifications and prices which are applicable to his product.

The following patents are not as close and are described briefly.

The Pellegrom Patent discloses a registry device including a transparent cover member which may be placed over an indicia-carrying substrate for purposes of checking printing alignment.

The Swan Patent discloses a transparent overlay with means for selectively blocking out unwanted data on a page which has a predetermined layout.

The Fumel Patent discloses a menu system where tickets can be extracted from the menu and given to the waiter for ordering purposes for making out the check.

The Brunner Patent discloses an overlay test measurement system which is used for checking the validity of photolithograpy plates used in manufacturing microelectronic circuits.

The Hodge Patent discloses an indexing overlay used in conjunction with video display devices and which attaches to the face of the display device.

The Burton Patent discloses a lotto ticket marking guide which is an overlay with rectangular slots which the lotto tickets can be placed under.

The Brunhoefer Patent discloses a layout sheet which is used for laying out production work in the printing and graphic industries which can be written on and has an adhesive type surface which allows arrangements of graphic or print works to be placed on the surface.

The Gannon Patent discloses a view through information converter which is used with a pre-printed information listing such as a television programming guide.

None of the known prior art have combined the concepts of a "best order number" reference system: which categorizes product data in specific product groupings and also categorizes product data of comparable competing products; which provides a method of finding corresponding price listings of alternative product lines; which provides a method of finding current inventories of a product; which displays other cross referenced information of similar products in highly specialized markets; and which provides a method of comparing business information between competing brand names in a particular product category in an easy to access manner by presenting the data in an overlay format which corresponds to a catalog of information and where the overlays align exactly to the catalog.

Therefore, there is a significant need for a specialized ordering system that enables a user to rapidly obtain the "best order number" and other information associated with a multiplicity of compatible company products used in conjunction with the cataloged product under consideration.

SUMMARY OF THE PRESENT INVENTION

The present invention relates to an ordering system that enables a user to rapidly obtain the "best order number" and price for any multiplicity of different brand names for the same product.

Efficient organization of product information is essential to the success of a business. When searching for highly specialized products of a particular category, it is useful to be able to easily associate products which are compatible to the highly specialized products in that category. To accomplish this, a "best order number" is assigned which references compatible products to cataloged products in a particular category of interest. Through a "best order number" system of cataloging and providing product compatibility information, the task of ordering new products become easier.

In the present invention, the buyer, seller or the business manager could examine various brands of specific product categories and reference alternative compatible products through a "best order number" system assigned to a particular product through the present invention's specialized order form technique.

The present invention utilizes an overlay table which is used in conjunction with a product catalog. The product catalog contains various features of the product and can contain text and illustrations of the product. Generally one page is devoted to the product description and advertisement. There is not enough room to include all the tables of product information for companies which have compatible products on the page of a product catalog which is also displaying the product features. To provide the necessary information, an overlay technique of presenting additional information, categorized by companies which have compatible products, is a workable solution to this problem.

The method of overlaying information can be used in many business situations where an overlay could associate one column of information to another. There are several types of business information which require updating on a regular basis. New companies with compatible products is one such type of business situation where a "best order number" overlay system could enable timely updating of compatible product information without reprinting a complete product catalog to include the information.

With the visual aid of a column overlay system and the "best order number" category system, it will be easy to reference corresponding business information of various tables of information. The column overlay structure is a desirable means of displaying information because it is interchangeable with other categories of information, it reduces the clutter associated with long lengthy tables, and is easy to reference because it is removable and can be aligned to a fixed catalog of information.

In general, the present invention is a "best order number" reference system: which categorizes the product data of a specific cataloged product and product data of compatible products; which provides a method of finding corresponding price listings of products which match those compatible products; which provides a method of finding current inventories of a product; which displays cross referenced information of similar products in highly specialized markets; which provides a method of comparing business information between different companies in a particular product category; and displays the information in an easy to access manner by presenting the data in an overlay format which corresponds to a catalog of information and where the overlays align exactly to the catalog.

It has therefore been discovered, according to the present invention, that a "best order number" reference system could categorize the product information of specific cataloged products with the product data of compatible products.

It has also been discovered, according to the present invention, that a "best order number" reference system could provide a method of finding price listings, current inventories and other pertinent business information, corresponding to the listings of various different companies in specific, highly specialized product categories.

It has further been discovered, according to the present invention, that a "best order number" reference system could display cross referenced information of similar products in highly specialized markets.

It has been additionally discovered, according to the present invention, to provide a means of finding compatible products between an assortment of companies of a particular product category in an easy to access manner.

It has also been discovered, according to the present invention, that by presenting the business information in an overlay format which corresponds to a catalog of information and where the overlays align exactly to the catalog, the information will be displayed in an easy to access manner.

It has therefore an object of the present invention to provide a "best order number" reference system which could categorize the product data of a specific cataloged product with product data of compatible products.

It is also an object of the present invention to provide a "best order number" reference system which provides a method of finding price listings, and other pertinent business information, corresponding to the listings of various different companies in specific, highly specialized product categories.

It is also an object of the present invention to provide a "best order number" reference system which could display cross referenced information of similar products in highly specialized markets.

It is an additional object of the present invention, to provide a means of finding compatible products between an assortment of companies of a particular product category, in an easy to access manner.

It is also an object of the present invention to present business information in an overlay format which corresponds to a catalog of information which contains the "best order number" and where the overlay fits to the catalog so that the information will be displayed in an easy to access manner.

In the preferred embodiment of the present invention the catalog of information displays various types of forceps which are used in conjunction with endoscopes. The endoscopes are made by different manufacturers and the forceps are designed to be adapted to the various manufacturer's versions of endoscopes. In this business situation, where a customer is interested in buying a specialized forceps designed for a particular application, the customer can look in the supplier's catalog for the page in which the particular forceps with the desired features is advertised, and by obtaining the overlay of that endoscope manufacturer of which the customer will be using, the customer can align the overlay of endoscopes to the catalog page which advertises the forceps, read across the row from his particular model of endoscope, and identify the "best order number" which associates a forceps which is compatible with his endoscope. The sales person can then associate price and inventory information to the "best order number" and place the order.

The present invention is not limited to only the comparison of product information with compatible products and systems, but could be used to present information which corresponds to any number of useful cross referencing situations.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a view of three overlays with a table of information on each.

FIG. 2 is a view of a catalog which contains a catalog page with a catalog table and a dashed line area to which the overlay could fit.

FIG. 3 shows the overlay fitting exactly over the page of the product catalog.

FIG. 4 shows the overlay table in close proximity to a catalog table.

FIG. 5 shows an actual overlay table and catalog table which lists product information, order numbers and associated price.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIG. 1, an assortment of overlays 5 are displayed. The overlays 5 have tabular row and column information pre-printed on it. The information on an overlay is usually computer generated. The overlays are generally made from an opaque flexible plastic material. There are usually pre-perforated index holes 15 close to the edge of the overlays 5, so that each, such as the first overlay 10, can fit rigidly by the pre-perforated index holes 15 to a notebook which features ring binders.

Three overlays are shown in FIG. 1, a first overlay 10, a second overlay 20 and a third overlay 30. Each of the overlays 5 correspond to a different company whose products are used harmoniously with the cataloged products.

Referring to FIG. 1 and FIG. 2, contained in the first overlay 10, there is an overlay table 1000 which contains product information in a column and row format which corresponds to information in a product catalog 100. The pages of the product catalog are usually held together by a ring binder.

Referring to FIG. 2, in the dashed line region 200 of the product catalog 100, there is normally text format product information 120 which generally describes important features of the cataloged product and a product illustration 110 which can provide information as to the size, shape and appearance of the item.

Also on the catalog page 100 is a catalog table 2000 which contains information related to the product. The catalog table 2000 is used in conjunction with the overlay table 1000. Information such as price, inventory and other important product information can be associated with the catalog table 2000 information. At least one coded number referred to as the "best order number" will usually be included on this table. When the "best order number" is determined, the "best order number" can be used by the customer to place an order. The "best order number" can be used by the manufacturer to track inventory, sales, price and other business related information.

The overlays 5 fit exactly to a dashed line region 200 on the page of the product catalog 100. The first overlay 10 can be held to the product catalog 100 by means of gaping punch holes 15 which snap into and clasp the notebook rings thereby binding to the notebook securely. The overlays 5 are typically made from a flexible opaque plastic material which can be used repeatedly and placed into the notebook ring at various pages of the notebook.

Referring to FIG. 3, overlay 10 is placed coincident to the dashed region 200 of a page of the product catalog 100. The overlay table 1000 is placed in close proximity to the catalog table 2000 on the page of the product catalog 100. In this arrangement, the rows of the overlay table 1000 match exactly to the rows of the catalog table 2000.

Referring again to FIG. 3, there is shown an overlay 10 which is fit to the dashed line section 200 of the catalog page 100. The dashed line section 200 is indicating the layout area in which the overlay 10 is placed. When the overlay 10 is snapped into place and held by the gaping punch holes 15, the overlay is naturally fit to the dashed line section 200. In the actual product there does not need to be a dashed outline printed on the page. It needs to be understood only for layout reasons, that the overlay 10 will be placed in this particular area on the layout. Aside from the first overlay 10, a second overlay 20, or a third overlay 30 could be used at the dash line section 200, each representing a different company with a specific assortment of products which are compatible to the cataloged product which corresponds to a completely different set of product information.

Referring to FIG. 4, there is shown an overlay table 1000 and a catalog table 2000. The tables are lined up so that the rows of the overlay table 1000 correspond to the rows of the catalog table 2000. This is the arrangement which has been previously indicated in FIG. 3. In general, this type of tabular form for each table is computer generated.

Referring again to FIG. 4, the overlay table 1000 is shown with three distinct product class designators 1500. The three distinct product class designators 1500 are in separate rows of the table and have text printed which displays the words "PRODUCT A", "PRODUCT B" and "PRODUCT C". There are also blank rows 1600 which are inserted into the table and can be placed at different locations in the table. The number of blank rows 1600 can vary between overlay tables 1000. Some blank rows 1600 can be shaded to represent separations between product classes.

In overlay table 1000, the first row 1010 contains a product class designator 1500. The product class designator 1500 is a sub-class of the product class which is compatible with the catalog product. The sub-classes of the overlay table 1000 are designated by the product class designator 1500. Referring to FIG. 3, the overlay table 1000 can have several sub-classes of products which are compatible to the catalog product described in the product catalog 100.

Referring again to FIG. 4, the second row 1020 of the overlay table 1000 has two column components. The column components for the table are designated at the lower part of the table. The first column component of the overlay table 1000 is the model array 1200. The second column of the overlay table 1000 is the specification designator 1300. Throughout the overlay table 1000, the columns are arranged with the two column components, a model array 1200 and a specification designator 1300, except for rows which are either a blank row 1600 or a product class designator 1500. As the need arises, other columns could be added to this arrangement.

The model array 1200 can contain several elements in the row which correspond to the specification designator 1300. In the second row 1020, there are three elements in this row of the model array 1200. These elements are listed as "A11", "A12", and "A13". Typically, these elements of the model array 1200 will be the actual model number of the product which is being referenced. These elements or model numbers are associated with the specification designator 1300, and fall into that specification category, which, in the second row 1020 is designated "SA1". The specification designator 1300 could be derived from a critical dimension of the product, such as a diameter, which corresponds to the adaptable part of the accompanying product referenced in the catalog table 2000.

The third row 1030 of the overlay table 1000 also has two column components, a model array 1200 and a specification designator 1300. Similarly, the fourth row 1040 of the overlay table 1000 has two column components. In this arrangement there is no actual limitation to the number of rows which would belong to the same sub-class except, for practical reasons, the table would usually be limited to one page because the cataloged product is generally limited to one page. In addition, the specification designator 1300 for one particular row could be repeated in subsequent rows if there were an excessive number of elements of the model array 1200 which could not fit into one row.

Referring to FIG. 5, there is shown an actual overlay table 1000 and catalog table 2000 which is used for displaying product information pertinent to flexible endoscopes. In this example, the catalog table 2000 is associated with a particular type of forceps which work in conjunction with several sub-classes of endoscopes. From the product class designator 1500 rows of the overlay table 1000, it can be seen that the sub-classes listed are "DUODENOSCOPES", "SIGMOIDOSCOPES", and "COLONOSCOPES". At the top of the table there is an overlay title row 1400 which aligns to the columns indicating product class and the specification type. In this example, it can be seen that the product class is "FLEXIBLE ENDOSCOPES" and the specification type is "WORKING CHANNEL/MM". In the catalog table 2000, there is a catalog title row 2400 which aligns to the "best order number" column 2200 and the price column 2300. It can be seen that the catalog title row 2400 contains the text "ORDER-NO." and "PRICE" in alignment with the order number column 2200 and the price column 2300 respectively.

In this example, the catalog table 2000 is associated with forceps which are designed to be used in conjunction with an assortment of different brands and sizes and models of endoscopes which are designated in the overlay table 1000. The various models of endoscopes are grouped in each row according to a specification designator 1300 which, in this case, is the working channel of this particular endoscope. The model array 1200 section of the overlay table 1000 contains the specific model of endoscope which corresponds to the product in the catalog table 2000.

In this example, the catalog of forceps contains various types of forceps used in the medical examination of the human anatomy. The forceps are used in conjunction with an assortment of compatible endoscopes which are listed on the aligned overlay table 1000. The forceps are adaptable to various manufacturer brands and types of endoscopes. Detailed product information about the forceps is usually not included in the catalog table 2000. Detailed product information is expected to be included, as described previously in FIG. 2, in other areas of the layout on the catalog page 100.

In using the "best order number" system to identify various brand names of compatible endoscopes which can be used with an assortment of different types of forceps, the user first identifies the brand of endoscope he intends to use, then he aligns the overlay to the page of the catalog which advertises the forceps he is interested in purchasing for use in conjunction with his endoscope.

Once the particular brand and version in that corresponding specification designator is located, the user then looks across the catalog page to the "best order number" column 2200 and uses this number to place his order. The accompanying catalog price column 2300 contains the price which is given for this particular product.

Generally, an entire page will be devoted to a particular cataloged product. The layout of that page will describe the features of the cataloged product. The "best order number" of that product is found by using the specific compatible product company overlay and finding the sub-class in that compatible product class and lining up, in a row to row arrangement, the overlay table 1000 to the catalog table 2000.

Defined in detail, the present invention is a best order number product reference system for presenting cataloged products and their association to compatible products which are used in conjunction with cataloged products, comprising: (a) a set of overlays, which present information with regard to a plurality of companies with compatible products; (b) an overlay table which has tabular information, relating to the class and agreement of the compatible products with respect to the cataloged products; (c) a product catalog which has catalog pages of product information relating to the cataloged products; (d) a catalog table on the catalog page which associates a best order number to the catalog product which is used in conjunction with the compatible products; (e) a reference best order number which associates a multiplicity of product information items to the best order number; and (f) a layout of the product catalog such that the overlays can fit to the catalog so that the information printed on the catalog table and the overlay table are displayed in a side by side arrangement for easy comparison.

Defined broadly, the present invention is a best order number product reference system for presenting cataloged products and their association to compatible products which are used in conjunction with cataloged products, comprising: (a) an overlay table on an overlay which relates information of the compatible products with respect to the cataloged products; (b) a catalog table on a catalog page which associates a best order number to the catalog product which is used in conjunction with the overlay table; and (c) a layout on the catalog page which displays catalog product information.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A best order number product reference system including a multiplicity of catalog products and their association to a multiplicity of compatible products from a multiplicity of manufacturers, the best order number product reference system comprising:

a. a multiplicity of overlays, each overlay having an overlay table of product information relating to said multiplicity of compatible products from said multiplicity of manufacturers;

b. a tabular information on said overlay table relating to a class and agreement of said multiplicity of compatible products;

c. a product catalog having a multiplicity of catalog pages of product information relating to said multiplicity of catalog products;

d. a catalog table on each of said catalog page which is associated with a best order number and a price to said multiplicity of catalog products and are used in conjunction with said multiplicity of compatible products of said multiplicity of manufacturers;

e. a reference number which is associated with a multiplicity of product information items to said best order number; and f. a layout location on each of said catalog page, the layout location having a text description and an illustration of said product information of said multiplicity of catalog products;

g. whereby each of said overlay is placed over said layout location so that said product information printed on said catalog table and said overlay table are displayed in a side by side arrangement for easy product comparison.

2. The invention as defined in claim 1 further comprising a product class designator, a specification designator and a model array on said tabular information of said overlay table.

3. The invention as defined in claim 1 wherein said multiplicity of overlays are flexible opaque plastic.

4. The invention as defined in claim 1 wherein said multiplicity of overlays has gaping holes on a side which fit into a notebook.

5. The invention as defined in claim 1 wherein said tabular information on said overlay table is in a row and column format.

6. The invention as defined in claim 1 wherein said catalog table of said catalog page is adjacent to said layout location so that each of said overlay can be aligned next to said catalog table.

7. The invention as defined in claim 1 wherein said best order number is associated with a price.

8. The invention as defined in claim 1 wherein said best order number is associated with inventory.

9. The invention as defined in claim 1 wherein said best order number is associated with said multiplicity of compatible products.

10. The invention as defined in claim 1 wherein said best order number is associated with said multiplicity of product information items by means of a computer program.

11. The invention as defined in claim 1 wherein said multiplicity of catalog pages of said product catalog fit into a notebook.

12. A method of comparing and selecting a multiplicity of catalog products with their association to a multiplicity of compatible products from a multiplicity of manufacturers, the method comprising the steps of:

a. providing said multiplicity of catalog products, each catalog product information being printed on a multiplicity of catalog pages of a product catalog;

b. preparing said multiplicity of compatible products of said multiplicity of manufacturers, each compatible product information of the manufacturer being printed on a multiplicity of overlays, which is relating to said multiplicity of catalog products;

c. placing each of said overlay on each said catalog page of said product catalog, so that the product information printed on each of said catalog page and each of said overlay are displayed in a side by side arrangement for easy product comparison;

d. comparing said multiplicity of catalog products to said multiplicity of compatible products of said multiplicity of manufacturers;

e. selecting a multiplicity of best order numbers, each best order number corresponding to said multiplicity of compatible products of said multiplicity of manufacturers; and f. ordering said multiplicity of best order numbers which correspond to said multiplicity of compatible products of said multiplicity of manufacturers.

* * * * *